US006539559B1

(12) United States Patent
Creech et al.

(10) Patent No.: US 6,539,559 B1
(45) Date of Patent: Apr. 1, 2003

(54) ANTI-LITTER FLOAT FOR A SWIMMING POOL AND METHOD OF USING ANTI-LITTER FLOAT FOR A SWIMMING POOL

(76) Inventors: Cathy L. Creech, 125 Catie La., London, KY (US) 40744; Karen Whitaker, 2637 River Rd., London, KY (US) 40744

( * ) Notice: Subject to any disclaimer, the term of this patent is extended or adjusted under 35 U.S.C. 154(b) by 0 days.

(21) Appl. No.: 10/012,148

(22) Filed: Nov. 3, 2001

(51) Int. Cl.[7] ..... E04H 4/00
(52) U.S. Cl. ..... 4/507; 4/498; 4/499
(58) Field of Search ..... 4/488, 496, 498, 4/499, 503, 506, 507, 510

(56) References Cited

U.S. PATENT DOCUMENTS

| | | | | | |
|---|---|---|---|---|---|
| 3,366,977 | A | | 2/1968 | Koehler | |
| 3,600,721 | A | * | 8/1971 | Pusey | 4/499 |
| 3,620,357 | A | | 11/1971 | Folkes | |
| 3,676,880 | A | * | 7/1972 | Kwake | 4/499 |
| 3,747,131 | A | * | 7/1973 | Koliomichalis | 4/499 |
| 4,048,678 | A | | 9/1977 | Chillino | |
| 4,109,325 | A | * | 8/1978 | Shuff | 4/499 |
| 4,122,561 | A | * | 10/1978 | Barr | 4/499 |
| 4,197,595 | A | * | 4/1980 | Dearing | 4/503 |
| 4,601,072 | A | * | 7/1986 | Aine | 4/499 |
| 4,606,083 | A | * | 8/1986 | Kingston | 4/580 |
| 4,685,254 | A | | 8/1987 | Terreri | |
| 4,825,479 | A | | 5/1989 | Bonneau | |
| 4,953,239 | A | | 9/1990 | Gadsby | |
| 5,144,704 | A | | 9/1992 | Genzel et al. | |
| 6,052,843 | A | | 4/2000 | Pirillo | |
| 6,128,791 | A | * | 10/2000 | Brocking | 4/498 |
| 6,286,157 | B1 | * | 9/2001 | Baumann | 4/503 |

* cited by examiner

*Primary Examiner*—Timothy L. Maust
*Assistant Examiner*—Khoa Huynh
(74) *Attorney, Agent, or Firm*—Kenneth F. Pearce

(57) ABSTRACT

An anti-litter float or balloon for a swimming pool. The single compartment balloon abuts continuously the containing wall, and the self-mooring balloon prevents litter from being disbursed into the pool water. Flaps and/or element-resistant covers can be used with the self-mooring single compartment balloon to batten down the swimming pool. The self-mooring single compartment float is sloped from the apex of its vertex downward toward the swimming pool's lip.

11 Claims, 4 Drawing Sheets

ANTI-LITTER FLOAT FOR A SWIMMING POOL AND METHOD OF USING ANTI-LITTER FLOAT FOR A SWIMMING POOL

BACKGROUND OF THE INVENTION

1. Field of the Invention

In the most general sense, the present invention relates to floats or balloons for swimming pools, and more particularly, anti-litter floats for preventing litter and/or natural elements, such as, rain, snow, ice., etc., from being disbursed into the pool water. The single compartment float's peripheral edges abut continuously the containing wall or walls of the swimming pool. Within the scope of the present invention, such abutments cause the balloons to be self-mooring. Flaps and/or element-resistant covers can also be utilized with the self-mooring floats to batten down the swimming pool. Whether incorporated with cylindrical, rectangular or other dimensioned swimming pools, the balloons conform to the shape of the containing wall or walls and slope downward from their respective vertexes toward the pool lips of the swimming pools in which they are floating. In accordance with select embodiments of the present invention, the self-mooring balloon operatively veils the intake of the skimmer.

2. Description of the Previous Art a) U.S. Pat. No. 3,366,977-Koehler discloses a swimming pool cover. The marginal portion of the cover (4) extends over the curbing of the swimming pool (3) and terminates in a hemmed portion (5) in which is inserted conveniently a reinforcing rod (6), along each peripheral edge of the cover . . . Secured to the underside of the pool cover (4) and extending along its longitudinal axis is an inflatable member (10) the peripheral edges of which are secured to the pool cover in an airtight manner. Upon anchoring the periphery of the pool cover around the edges of the swimming pool and inflating the inflatable member (10) the pool cover (4) assumes an arched position extending in all directions.

b) U.S. Pat. No. 6,052,843-Pirillo enables a float-retaining covering device. The Prillo device is designed to provide a cover device that retains a floating member in a central portion of the pool. In other words, the '843 Patent teaches a cover sheet (12) and a float (14), each with anchoring mechanisms. Retaining grommets (20) and one or more cords (22) secure the float directly to the cover sheet (12). Prillo also utilizes straps in combination with snaps, hook and loop type fasteners, buckles, latches, knots and clips to secure float (14) to cover sheet (12).

c) U.S. Pat. No. 4,953,239-Gadsby describes an inflatable pool cover and blower combination Gadsby cover (10) includes shaping members (15) for preventing the cover (10) for assuming a cylindrical shape when inflated. The '239 Patent's shape retaining members (15) are affixed to the inside of the upper layer (12) and lower layer (14) of cover (10) by thermal welding.

d) U.S. Pat. No. 5,144,704-Genzel, et. al., teaches a swimming pool cover that has multiple air compartments. Cover 10 includes an exposed top surface (14) and air compartments (16A, 16B, etc . . . ) Genzel's weights (20) spaced at the edge of the pool hold the pool cover (10), or if desired, other well known devices such as clamps or grommets can be used to fasten the outer edges of the pool cover (10) to the pool body, or to the surrounding deck or the ground.

f) U.S. Pat. No. 4,825,479-Bonneau discloses an inflatable swimming pool cover. The Bonneau device mandates a convex cover sheet (18) and a skirt (20) which has a series of holes (24) that hangs in the water inside the peripheral wall (12) of swimming pool (10). When inflated, the '479 Patent's cover (16) floats on a cushion of air. In order to stabilize the cover and prevent cover (16) from rotating or being moved sideways by a breeze or the wind, the cover (16) is anchored to the platform (14) by a series of elastic cables (44) disposed evenly around the swimming pool.

g) U.S. Pat. No. 4,048,678-Chillino defines an inflatable swimming pool cover. The Chillino cover (11) has an inner skirt (20) that extends around the dome (16) such that skirt lies against the inner pool wall (13) and extends below the water level. The '678 Patent's skirt (20) is welded to the main body (16) of the cover (11) to create a positive seal so there is no loss of air pressure. Due to the positive seal there is no evaporation or loss of pool water, while the dome (16) prevents overflow of pool water by causing rain water to run off.

h) U.S. Pat. No. 4,685,254-Terreri enables a support for a swimming pool cover. The '254 Patent's cover support (22) is located on the surface of the water (16) underneath cover (20). The Terreri cover support (22) has a spherical balloon (24) and an air hose (24) that reaches from the edge of the pool to the balloon (24) that is centered in the pool. Terreri's cover support (22) requires the balloon (24) to utilize grommets (32) and lines (33) to secure the balloon (24) on the surface of the water (16) in the center of the pool (10).

SUMMARY OF THE INVENTION

The present device and method of using the device are directed toward preventing litter, debris and/or other natural elements from accumulating or disbursing in swimming pools. Peripheral edges of the self-mooring single compartment balloons or floats are coplanar with and abut virtually continuously the containing wall or walls of the swimming pool. Undersides of the self-mooring single compartment balloons engage virtually all of the uppermost surface area of pool water. Topsides of the single compartment balloons slope from their respective vertexes toward the pool lip or lips that extend outward from the upper circumference(s) of the containing wall and/or walls. Flaps including weights can be attached to the topsides of the self-mooring floats to batten down the swimming pool, or alternative embodiments can employ element-resistant covers to batten down the swimming pool.

In accordance with the present invention, self-mooring single compartment balloons are fabricated of compositions that will float, when inflated. And select embodiments of the self-mooring floats are adapted for creating an operative veil in combination with a skimmer's intake. Other embodiments include a stop that is inserted into the skimmer's intake to prevent pool water from flowing into the skimmer's intake. Depending upon the embodiment of the current invention practiced, the uppermost surface area of the pool water can be above the upper borderline of the skimmer's intake, or the uppermost surface area of the pool water can be positioned at or below the lower borderline of the skimmer's intake. Thus, regardless of the pool water's uppermost water level, one or more embodiments of the present invention can be practiced to prevent litter from accumulating in the pool water.

An object of the present invention is to provide a device for preventing accumulation of litter or other debris in swimming pools.

It is another object of the present invention to enable a method utilizing single compartment balloons or floats, within the scope of the present invention.

Still another object of the present invention is to provide a self-mooring float or balloon.

Yet another object of the present invention is to provide an anti-litter device utilizing balloons with sloped topsides.

Still another object of the present invention is to provide an anti-litter device including flaps.

Yet still another object of the present invention is provide an anti-litter device including an elemental resistant cover.

It is yet another object of the present invention to provide an anti-litter float having a stop tethered to the float to prevent pool water from flowing into the pool's skimmer and to further secure the self-mooring balloon.

Still another object of the present invention is provide a self-mooring balloon that operatively veils the skimmer's intake.

Yet still another object of the present invention is provide an anti-litter device that battens down the swimming pool.

It is yet another object of the present invention to provide an anti-litter float that functions with a swimming pool having a cylindrically shaped containing wall.

Still another object of the present invention is provide an anti-litter float that functions with rectangular-shaped or other dimensioned swimming pools' containing walls.

Yet still another object of the present invention is provide an anti-litter device that prevents the skimmer from containing pool water that could encounter numerous freeze-thaw cycles during the winter season.

It is yet another object of the present invention to provide an anti-litter float that functions in gale-like winds.

Still another object of the present invention is provide an anti-litter float including at least one valve for inflating the self-mooring single compartment balloon.

An embodiment of the present invention can be described as an anti-litter float device for use in combination with a swimming pool having a containing wall for pool water, comprising: a pool lip in communication with and located above the containing wall; a skimmer connected to the containing wall, wherein the skimmer includes an intake coupled to the containing wall for carrying the pool water to the skimmer; an upper surface area of the pool water, wherein the upper surface area of the pool water is defined by a level of the pool water nearest the pool lip and held by the containing wall; the intake having a lowest borderline disposed at or above the upper surface area of the pool water; a single compartment balloon abutting continuously the containing wall such that the single compartment balloon is self-mooring, when the single compartment balloon is inflated; and wherein the self-mooring single compartment balloon further comprises: an underside engaging virtually all of the uppermost surface area of the pool water such that the self-mooring single compartment balloon floats on the uppermost surface area of the pool water, a peripheral edge abutting and coplanar with the containing wall of the swimming pool, the peripheral edge extending upwardly from the underside and beyond an uppermost borderline of the intake such that the peripheral edge operatively veils the intake, a topside extending from the peripheral edge and sloped toward a vertex of the self-mooring single compartment balloon, wherein the vertex rises to an apex superior to the pool lip, and a valve for inflating the self-mooring single compartment balloon.

Another embodiment of the present invention can be described as an anti-litter float device for use in combination with a swimming pool having a containing wall for pool water, comprising: a pool lip in communication with and located above the containing wall; a skimmer connected to the containing wall, wherein the skimmer includes an intake coupled to the containing wall for carrying the pool water to the skimmer; an upper surface area of the pool water, wherein the upper surface area of the pool water is defined by a level of the pool water nearest the pool lip and held by the containing wall; a stop for the intake such that the stop prevents the pool water from being carried to the skimmer; a single compartment balloon abutting continuously the containing wall such that the single compartment balloon is self-mooring, when the single compartment balloon is inflated; and wherein the self-mooring single compartment balloon further comprises: an underside engaging virtually all of the uppermost surface area of the pool water such that the self-mooring single compartment balloon floats on the uppermost surface area of the pool water, a peripheral edge abutting and coplanar with the containing wall of the swimming pool, a topside extending from the peripheral edge and sloped toward a vertex of the self-mooring single compartment balloon, wherein the vertex rises to an apex superior to the pool lip, and a valve for inflating the self-mooring single compartment.

In still another embodiment, the present invention can be described as a method for shielding an upper surface of a swimming pool's water from litter, comprising the steps of: lowering the swimming pool water to at least a lowest borderline of an intake of a skimmer of the swimming pool; floating a single compartment balloon on the upper surface area of the swimming pool's water, wherein the single compartment balloon includes: an underside for engaging virtually all of the upper surface area, a peripheral edge for abutting a containing wall of the swimming pool, and a topside for shielding the pool water; inflating the single compartment balloon to: self-moor by abutting against the containing wall, operatively veil the intake of the skimmer of the swimming pool, and slope to a vertex having an apex higher than a lip of the swimming pool; covering the self-mooring single compartment balloon and the pool lip with an element-resistant cover; and tying the element-resistant cover against the self-mooring single compartment balloon and the pool lip to batten down the swimming pool against litter.

In yet another embodiment, the present invention can be described as a method for shielding an upper surface of a swimming pool's water from litter, comprising the steps of: floating a single compartment balloon on the upper surface area, wherein the single compartment balloon includes: an underside for engaging virtually all of the upper surface area, a peripheral edge for abutting a containing wall of the swimming pool, and a topside for shielding the pool water; inflating the single compartment balloon to: self-moor by abutting against the containing wall, and slope to a vertex having an apex higher than a lip of the swimming pool; stopping the pool water's flow into an intake of a skimmer of the swimming pool; covering the self-mooring single compartment balloon and the pool lip with an element-resistant cover; and tying the element-resistant cover against the self-mooring single compartment balloon and the pool lip to batten down the swimming pool against litter.

It is the novel and unique interaction of these simple elements which creates the devices and methods, within the ambit of the present invention. Pursuant to Title 35 of the United States Code, descriptions of preferred embodiments follow. However, it is to be understood that the best mode descriptions do not limit the scope of the present invention.

BRIEF DESCRIPTION OF THE DRAWINGS

With the containing wall cutaway.

With the front containing wall cutaway.

DESCRIPTION OF THE PREFERRED EMBODIMENTS

Figure 1:
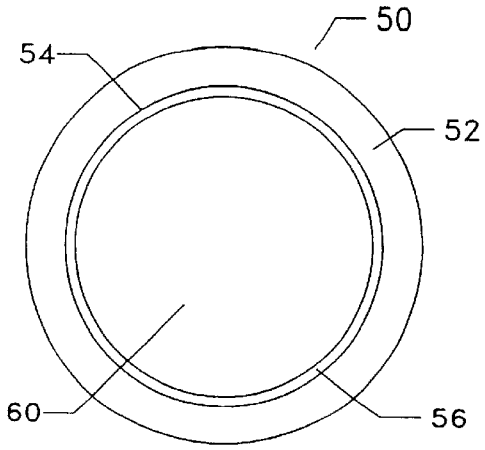
FIG. 1 is a top view of a cylindrical shaped swimming pool employing an embodiment of the present invention, within the scope of the present invention.

Although the disclosure hereof is detailed to enable those skilled in the art to practice the invention, the embodiments published herein merely exemplify the present invention. FIG. 1 is a top view of cylindrically shaped swimming pool (50) employing an embodiment of the present invention. Whether above or at ground level, pool lip (52) extends outwardly from the top circumference (54) of containing wall (56) of swimming pool (50). Containing wall (56) extends downward from top circumference (54), and although not shown in this perspective, containing wall (56) holds pool water. As shown in FIG. 1, single compartment balloon (60) abuts continuously containing wall (56) of swimming pool (50). The abutting between the containing wall (56) and single compartment balloon (60) is sufficiently continuous to both deter the accumulation of litter, such as, leaves, etc., away from the pool water while also causing the single compartment balloon (60) to be self-mooring.

Figure 2:
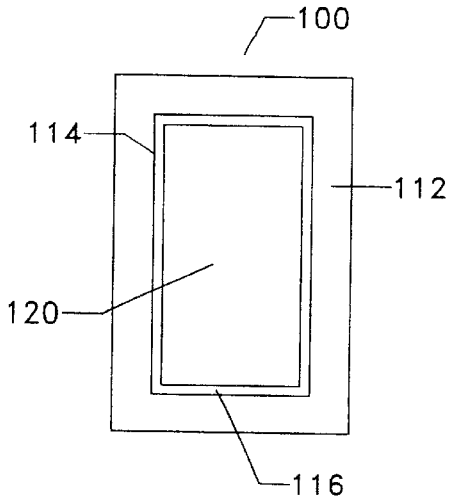
FIG. 2 is top view of swimming pool having a rectangular-shaped dimension and utilizing another embodiment, within the ambit of the present invention.

FIG. 2 is top view of swimming pool (100) having a rectangular-shaped dimension. Whether above or at ground level, pool lip (112) extends outwardly from top circumference (114) of containing wall (116) that extends downward from the pool lip (112) to hold the pool water. As with the cylindrically fashioned embodiment previously disclosed, a single compartment balloon (120) abuts continuously containing wall (116) of swimming pool (100) such that the underside (not shown) of single compartment balloon (120) engages virtually the entire uppermost surface area of the pool water (not shown). It has unexpectedly been determined that this self-mooring single compartment balloon (120) is also particularly useful in deterring the accumulation of litter in the pool water.

Cylindrical and rectangular-shaped swimming pools in combination with self-mooring single compartment balloons have thus far been disclosed. However, those skilled in the art recognize that other dimensions of swimming pools and self-mooring single compartment balloons are also within the scope of the present invention. And although additional elements of the current invention are shown in relation to rectangular-shaped swimming pools, it is understood that those elements also function in accordance with cylindrical or other shaped swimming pools.

Figure 3:
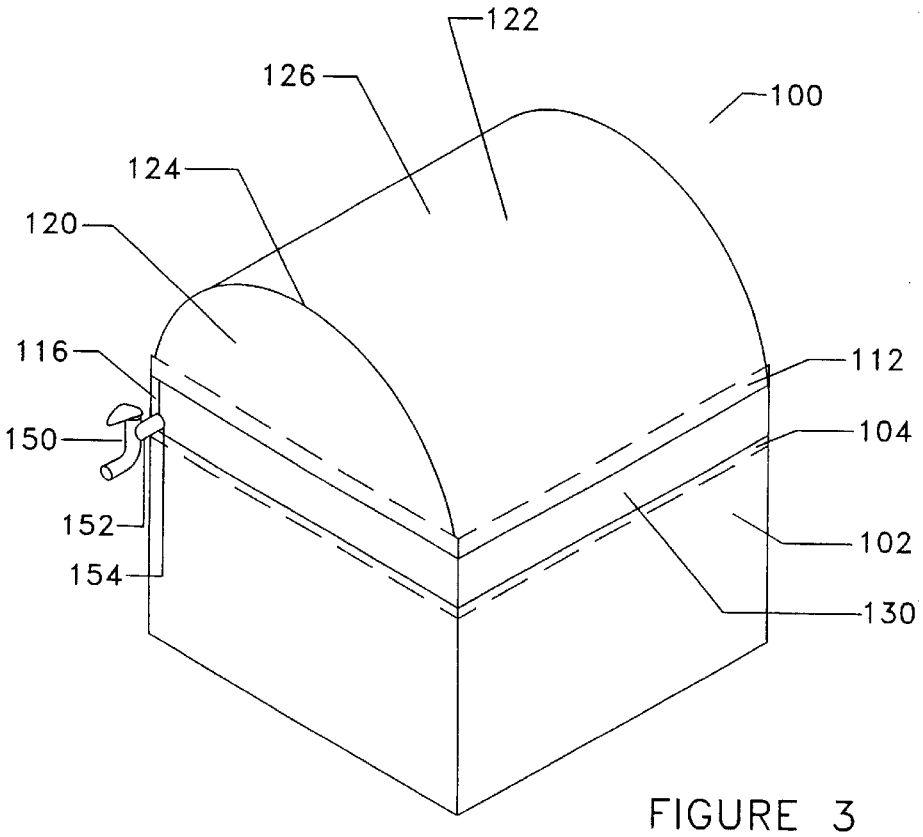
FIG. 3 is a frontal partial cutaway pictorial perspective of a swimming pool having a skimmer, within the scope of the present invention.

FIG. 3 is a frontal partial cutaway pictorial perspective of swimming pool (100) including skimmer (150). Those skilled in the art understand that the repeated freezing and thawing of skimmers during a wintertime season damages the skimmer. In accordance with another feature of the present invention, during the off-season, pool water can be prevented from flowing into the skimmer, thereby enhancing the working life of the skimmer.

With a view still toward FIG. 3, single compartment balloon (120) floats on upper surface area (104) of pool water (102) and abuts continuously containing wall (116) of swimming pool (100). Topside (122) of single compartment balloon (120) slopes upward toward vertex (124) having apex (126) of self-mooring single compartment balloon (120). Apex (126) and vertex (124) are superior to pool lip (112) so that natural elements such as rain, snow, sleet, etc. drain downward.

Figure 4:
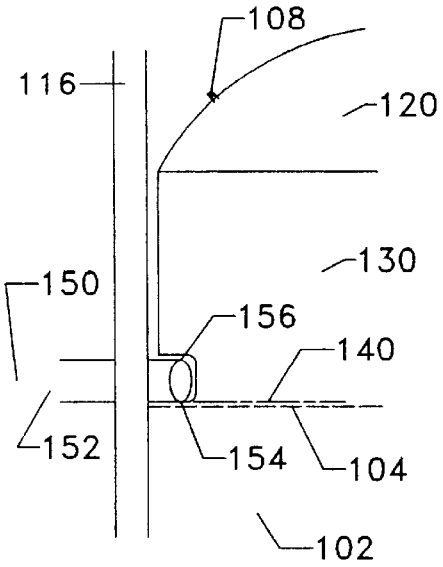
FIG. 4 is a close up perspective showing the operative veil embodiment of the present invention.

Peripheral edge (130) of self-mooring single compartment balloon (120) is coplanar with and abuts containing wall (116). Although not shown from this perspective, underside (140) of floating self-mooring single compartment balloon (120) engages virtually all of uppermost surface area (104) of pool water (102). Intake (152) of skimmer (150) couples the skimmer to containing wall (116), and as shown in FIG. 3, intake (152) has lowest borderline (154) disposed above uppermost surface area (104) of pool water (102). FIG. 4, with the containing wall (116) cutaway, is a close up perspective showing the operative veil embodiment of the present invention. Underside (140) of self-mooring single compartment balloon (120) floats on upper surface area of (104) of pool water (102). When air is pumped from an air supply (not shown) through valve (108) of single compartment balloon (120), among other things, peripheral edge (130) expands to operatively veil intake (152) from lowest borderline (154) to highest borderline (156). Self-mooring single compartment balloon (120) is manufactured of such a composition, for example, soft plastic, such that upon inflation, it can operatively veil the intake (152), thereby preventing pool water (102) from being carried through intake (152) to skimmer (150).

Figure 5:
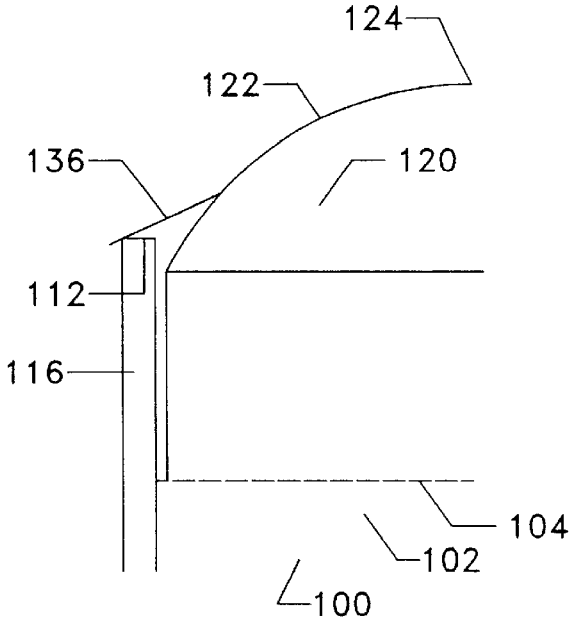
FIG. 5 is a cutaway perspective showing a flap embodiment of the current invention.

FIG. 5 is a cutaway perspective revealing a flap embodiment of the current invention. Flap (136) is attached, in any manner acceptable in the art, such as snaps or catches, to self-mooring single compartment balloon (120). Moreover, depending upon user preference, flap (136) can circumscribe either part or all of topside (122) of self-mooring single compartment balloon (120). Additionally, flap (136) can also be manufactured as a single piece to seat against the peripheral surface area of self-mooring single compartment balloon (120), i.e., circumscribe topside (122) of self-mooring single compartment balloon (120). Flap (136) can include weights (not shown) to prevent flap (136) from being wind blown in gale-like conditions. Although in this perspective, the frontal side of flap (136) is cutaway, as shown, those skilled in the art recognize that flap (136) is dimensioned to extend laterally away from self-mooring single compartment balloon (120) and over pool lip (112) above the containing wall (116). Utilization of the flap embodiment of the present invention allows both litter and natural elements to drain from vertex (124) of the sloped topside (122) over flap (136) and away from the pool water (102) of swimming pool (100).

Figure 6:
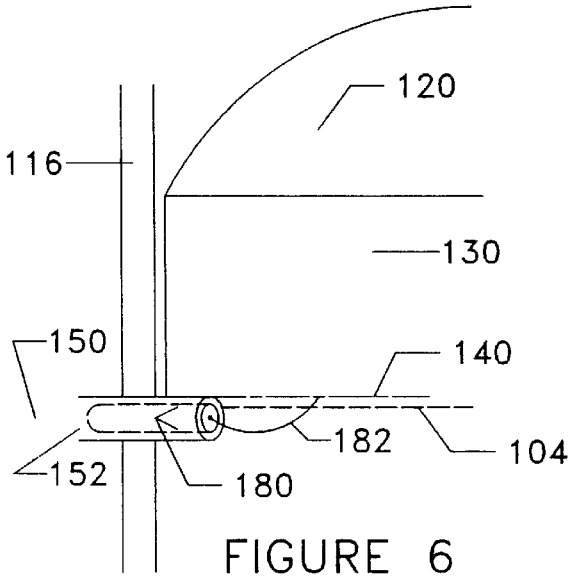
FIG. 6 is a close-up perspective of an embodiment incorporating a stop, within the ambit of the present invention.

FIG. 6 is a containing wall frontal cutaway close-up perspective of an embodiment incorporating a stop, within the ambit of the present invention. Underside (140) of self-mooring single compartment balloon (120) floats on upper surface area of (104) of pool water (102). When single compartment balloon (120) is inflated, among other things, peripheral edge (130) of self-mooring single compartment balloon (120) expands to abut containing wall (116). Stop (180) is tethered to single compartment balloon (120) via line (182), and line (182) can be connected to self-mooring single compartment balloon in any manner acceptable in the art. After stop (180) is inserted into intake (152) it prevents pool water (102) from being carried to skimmer (150). In select embodiments, stop (180) and tether line (182) can also further secure self-mooring balloon (120).

Figure 7:
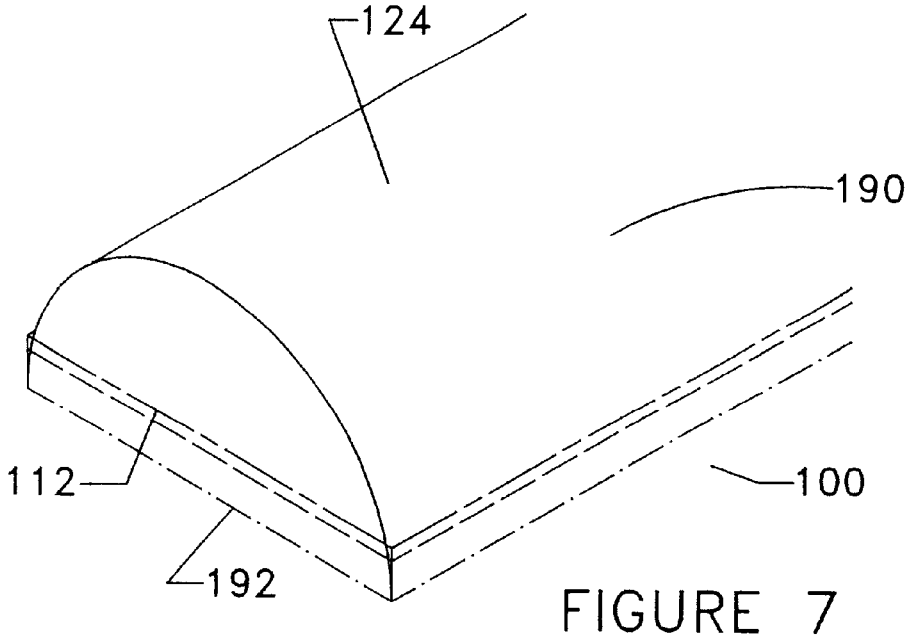
FIG. 7 is a side view depiction of a battened down embodiment of the present invention.

FIG. 7 is a side view depiction of a battened down embodiment of the present invention. Element-resistant cover (190) is of greater area than topside (not shown) of self-mooring single compartment balloon such that it covers self-mooring single compartment balloon (not shown). As shown, element-resistant cover (190) slopes downward from vertex (124) of self-mooring single compartment balloon (120) and over pool lip (112) of swimming pool (100). A tie (192), for example, a rope or cord, secures element-resistant cover (190) against self-mooring single compartment balloon and pool lip such that litter and the natural elements drain downward from the vertex and away from the swimming pool. In short, the combination of the element-resistant cover (190) and the self-mooring single compartment balloon battens down the swimming pool (100).

Figure 8:
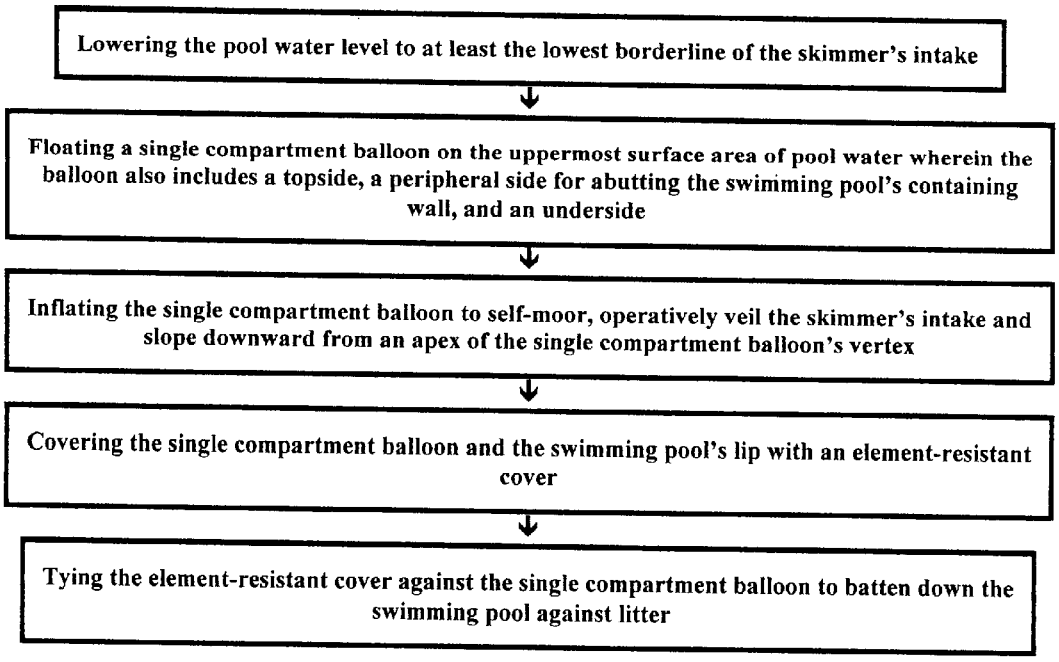
FIG. 8 is an illustration of the steps of an embodiment of the present method.
Figure 9:
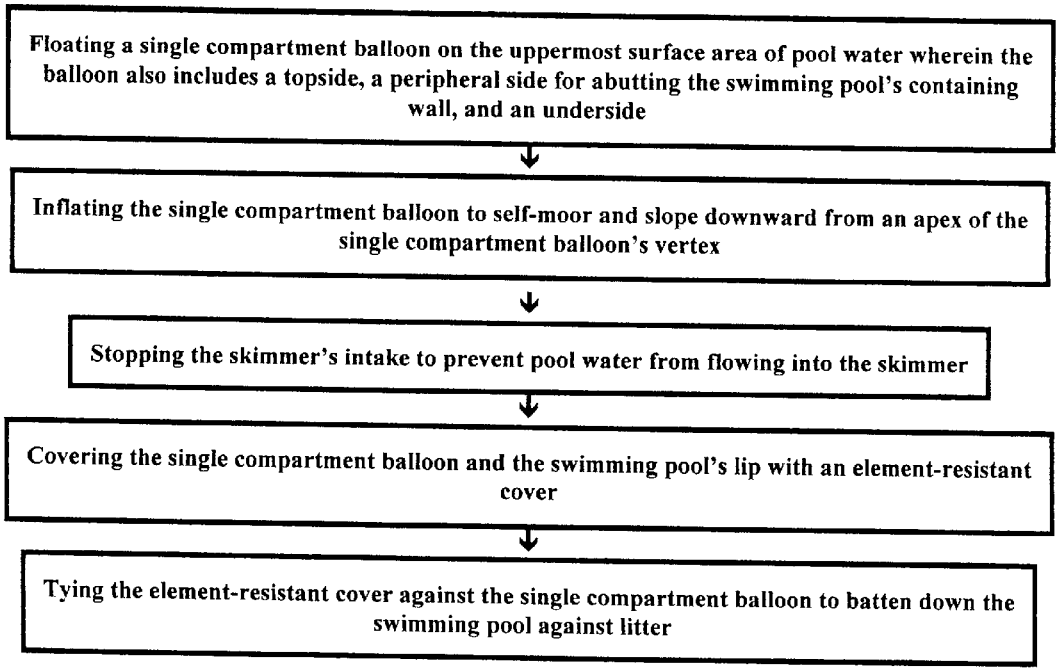
FIG. 9 is an exemplification of the steps of another embodiment of the present method.

Steps associated with the practice of the methods of present invention utilizing select structural elements enabled above are set forth in FIGS. 8–9. Having disclosed the invention as required by Title 35 of the United States Code, Applicants now pray respectfully that Letters Patent be granted for their invention in accordance with the scope of the claims appended hereto.

What is claimed is:

1. In combination with a swimming pool having a containing wall for pool water, an anti-litter float, comprising:

a) a pool lip in communication with and located above said containing wall;

b) a skimmer connected to said containing wall, wherein said skimmer includes an intake coupled to said containing wall for carrying said pool water to said skimmer;

c) an upper surface area of said pool water, wherein said upper surface area of said pool water is defined by a level of said pool water nearest said pool lip and held by said containing wall;

d) said intake having a lowest borderline disposed at or above said upper surface area of said pool water;

e) a single compartment balloon abutting continuously said containing wall such that said single compartment balloon is self-mooring, when said single compartment balloon is inflated; and f) wherein said self-mooring single compartment balloon further comprises:

i) an underside engaging virtually all of said uppermost surface area of said pool water such that said self-mooring single compartment balloon floats on said uppermost surface area of said pool water;

ii) a peripheral edge abutting and coplanar with said containing wall of said swimming pool;

iii) said peripheral edge extending upwardly from said underside and beyond an uppermost borderline of said intake such that said peripheral edge operatively veils said intake;

iv) a topside extending from said peripheral edge and sloped toward a vertex of said self-mooring single compartment balloon, wherein said vertex rises to an apex superior to said pool lip; and vi) a valve for inflating said self-mooring single compartment balloon.

2. The combination of claim 1 wherein said containing wall is cylindrical.

3. The combination of claim 2 further comprising a flap extending outwardly from said self-mooring single compartment balloon and over said pool lip.

4. The combination of claim 2 further comprising an element-resistant cover having a surface area for covering said self-mooring single compartment balloon and said pool lip such that said element-resistant cover battens down said swimming pool to shield said upper surface of said pool water from litter.

5. The combination of claim 4 further comprising a tie for said element-resistant cover.

6. The combination of claim 1 wherein said containing wall further comprises a plurality of sides.

7. The combination of claim 6 wherein each of said plurality of sides is perpendicular to another of each of said plurality of sides.

8. The combination of claim 7 further comprising a flap extending outwardly from said self-mooring single compartment balloon and over said pool lip.

9. The combination of claim 7 further comprising an element-resistant cover having a surface area for covering said self-mooring single compartment balloon and said pool lip such that said element-resistant cover battens down said swimming pool to shield said upper surface of said pool water from litter.

10. The combination of claim 9 further comprising a tie for said element-resistant cover.

11. A method of shielding an upper surface of a swimming pool's water from litter, comprising the steps of:

a) lowering said swimming pool water to at least a lowest borderline of an intake of a skimmer of said swimming pool;

b) floating a single compartment balloon on said upper surface area of said swimming pool's water, wherein said single compartment balloon includes:

i) an underside for engaging virtually all of said upper surface area;

ii) a peripheral edge for abutting a containing wall of said swimming pool; and iii) a topside for shielding said pool water;

c) inflating said single compartment balloon to:

i) self-moor by abutting against said containing wall;

ii) operatively veil said intake of said skimmer of said swimming pool; and iii) slope to a vertex having an apex higher than a lip of said swimming pool;

d) covering said self-mooring single compartment balloon and said pool lip with an element-resistant cover; and e) tying said element-resistant cover against said self-mooring single compartment balloon and said pool lip to batten down said swimming pool against litter.

* * * * *